United States Patent [19]

Bennett

[11] Patent Number: 4,733,784

[45] Date of Patent: Mar. 29, 1988

[54] CONTAINER AND APPLICATOR FOR FLUIDS

[75] Inventor: Robert Bennett, Easton, Conn.

[73] Assignee: R.J.S. Industries, Inc., Marlboro, N.J.

[21] Appl. No.: 931,543

[22] Filed: Nov. 17, 1986

[51] Int. Cl.[4] ..... B65D 1/02

[52] U.S. Cl. ..... 215/32; 215/228; 215/33; 206/216; 206/229; 401/122; 222/541

[58] Field of Search ..... 206/209, 216, 229, 15.2; 215/32, 33, 228; 401/120, 129, 121, 122; 222/541

[56] References Cited

U.S. PATENT DOCUMENTS

| | | | |
|---|---|---|---|
| 1,886,651 | 11/1932 | De George | 206/15.2 |
| 3,086,820 | 4/1963 | Baumgartner | 206/229 |
| 3,416,712 | 12/1968 | Shastal | 222/541 |
| 4,260,065 | 4/1981 | Van Cromvoirl | 215/32 |
| 4,410,096 | 10/1983 | Paradis | 215/32 |

FOREIGN PATENT DOCUMENTS

| | | | |
|---|---|---|---|
| 16707 | 3/1934 | Australia | 206/229 |
| 391185 | 8/1965 | Switzerland | 206/15.2 |
| 379040 | 8/1932 | United Kingdom | 206/15.2 |
| 835862 | 5/1960 | United Kingdom | 206/15.2 |

*Primary Examiner*—David T. Fidei

[57] ABSTRACT

A vertical hollow container has a hollow interior chamber adopted to store fluid. The lower end of the container is sealed. A bowl shaped member with an opening in the bottom thereof is disposed in the upper and of the container. The member has an exposed upper surface. The opening flares outwardly as it extends downwardly through the member into the chamber. A vertical prong shaped plastic element extends downwardly into the member and is secured at its lower end to the upper surface of the member in the region of the opening to seal the opening in a leak proof manner. The element has a vertical bore extending upwardly from the lower end to a point intermediate the ends. The element, when manually pivoted about the opening, breaks away from the container and breaks the seal to expose the opening whereby the element can be removed from the container. Vertical bristles are secured in the bore and extend downwardly out of the lower end of the element through the opening in the member and into the chamber. An horizontal annular lip is secured to the upper surface of the member adjacent the upper end of the container and extends into the interior of the member whereby excess fluid on the bristles can be wiped off by moving the bristles over the lip.

4 Claims, 7 Drawing Figures

CONTAINER AND APPLICATOR FOR FLUIDS

BACKGROUND OF THE INVENTION

Potential users of cosmetic fluids such as nail polish do not want to purchase relatively large containers of fluids which may prove to be unsatisfactory after purchase. For example, a nail polish color as displayed on the container may appear to be satisfactory before actual use, but may be found to be unsatisfactory when the polish is actually applied to the nails. It is, of course, possible for a potential user to purchase the container and throw it away after one unsatisfactory application, but such action is obviously costly and undesirable. The same problem arises when purchases of cans of paint or other fluid materials are made.

A primary object of this invention is to provide a new type of small leakproof container and applicator of fluids which is inexpensive and can even be thrown away after use and which will enable a prospective user to test use a small quantity of fluid before deciding whether or not to purchase a larger container of fluid. For example, when the fluid is nail polish, a new type container may contain only enough polish to enable the user to test a single coat on all ten nails.

SUMMARY OF THE INVENTION

A container and applicator, in accordance with the principles of the present invention, utilizes a small plastic container having a hollow interior chamber adapted to store the desired fluid. The container has upper and lower ends. A downwardly disposed bowl shaped member is disposed in the upper end. The member has an exposed upper surface and has an opening in the bottom which flares outwardly as it extends downwardly through the member into the chamber.

A vertical prong shaped plastic element is secured at its lower end to the upper surface of the member in the region of the opening to seal the opening in a leak proof manner. The element extends upwardly out of the member and has a vertical bore that extends upwardly from the lower end of the element to a point intermediate the ends thereof. The element when manually pivoted about the opening breaks away from the container and at the same time breaks the seal and exposes the opening. The element can then be removed from the container.

Vertical bristles are secured in the bore and extend downwardly out of the element and through the opening into the chamber. When the element is broken away from the recess, the element with the bristles can be removed from the container and the element can be used as a handle to repeatedly dip the bristles in the fluid to charge the bristles with fluid for repeated application as desired by a user.

The plastic used must have the characteristic brittleness which will enable the element to be broken away from the container by the manual pivotal action previously described and must be chemically inert with respect to the fluid fill.

This container and applicator will not leak before the element is broken away from the container and can be stored with the fluid therein for months before use. Once the element has been broken away from the the container and the seal has been broken to expose the opening in the upper end of the container, the fluid must be used immediately because it may deteriorate with exposure to air and, in any event, the opening cannot be resealed with the element so the container may leak.

The foregoing and other objects and advantages of this invention will either be explained or will become apparent to those skilled in the art when this specification is read in conjunction with the accompanying drawings.

DETAILED DESCRIPTION OF PREFERRED EMBODIMENTS

Figure 1:
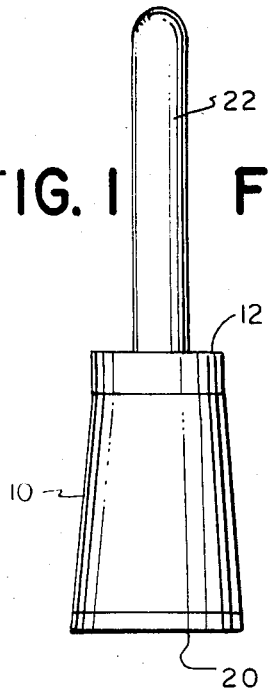
FIG. 1 is a side view of one embodiment of the invention prior to use.
Figure 2:
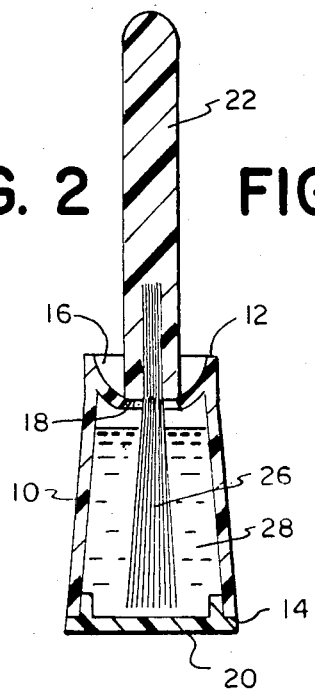
FIG. 2 is a vertical cross sectional view of the structure of FIG. 1.
Figure 4:
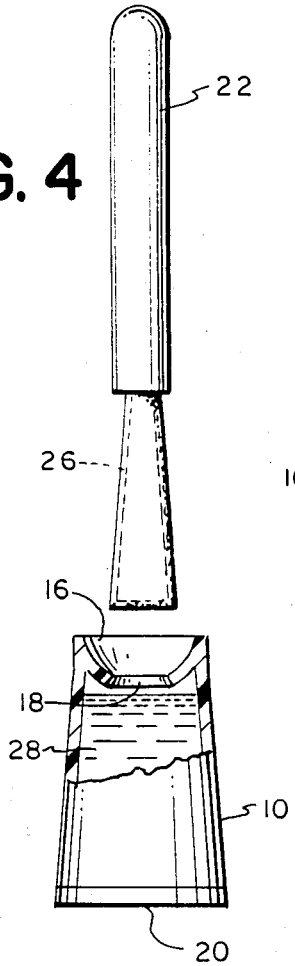
FIG. 4 is a view similar to FIG. 1 but showing the embodiment ready for use.
Figure 3:
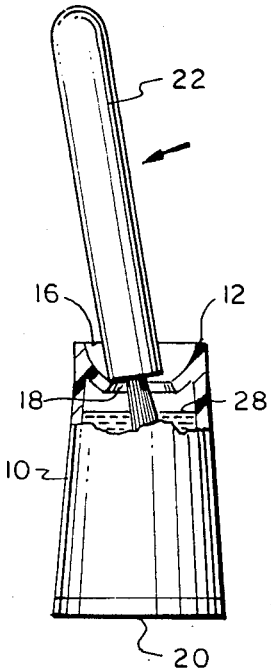
FIG. 3 illustrates the manual pivoting action which frees the element from the container.
Figure 5:
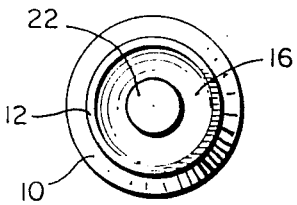
FIG. 5 is a top view of the structure of FIG. 1.
Figure 6:
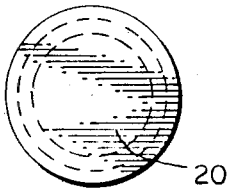
FIG. 6 is a bottom view of the structure of FIG. 1.
Figure 7:
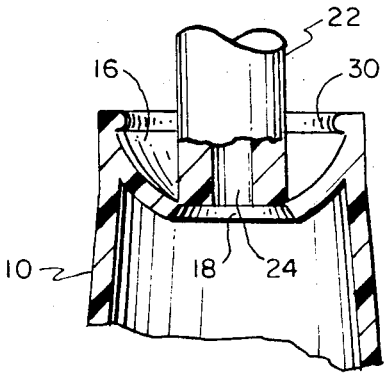
FIG. 7 is a detail cross sectional view of a portion of the structure shown in FIG. 2.

Referring now to FIGS. 1–7, there is shown a hollow vertical plastic container 10 which flares somewhat outwardly and downwardly from the upper end 12 to the lower end 14. The upper end has secured therein a downwardly extending bowl shaped member 16 with a centrally disposed bottom opening 18 which extends downwardly through the member 16 and into the hollow interior of the container. The inner periphery of the top of the recess can have an inwardly projecting lip 30. Opening 18 has an outwardly and downwardly flaring chamfer of about forty five degrees. The lower end 14 is open and is sealed closed by a snap fitting plastic disc 20.

A vertical prong shaped vertical plastic element 22 is secured at its lower end in the recess and seals off the opening in an air-tight and liquid-tight seal. Element 22 has a vertical bore 24 which extends upwardly from its lower end to a point intermediate its ends but closer to the lower end than to the upper end. Vertical bristles 26 are secured in the bore and extend downwardly into the interior of the container.

The element, when manually pivoted about its lower end will break away from the container and expose the opening. The plastic used should be stiff and should be brittle enough to enable the breaking action to take place. A plastic known by the tradename BEREX can be used for this purpose.

In use, the element with its bore and the container without disc 20 is molded as a single integral unit. The bristles are inserted via the open end of the container. The container is then inverted and filled with fluid 28. The disc 20 is then snap fitted into position and then is sonically welded in place. The chamber is then leak proof.

Any suitable fluid 28 such as nail polish or other material can be used and applied in the manner previously described. Excess fluid can be wiped off the bristles by moving the bristles over the lip 30. The material cannot react chemically with the plastic used. Chemically inert plastics of the type described are well known.

While preferred embodiments of the invention have been described above, it will be apparent to those skilled in the art that numberous modifications thereof can be made without departing from the invention as defined by the scope of the claims that follow.

What is claimed is:

1. A container and applicator for fluids comprising:

a vertical plastic container having a hollow interior chamber adapted to store fluid, the container having upper and lower ends, the lower end being sealed;

a downwardly extending bowl shaped plastic member disposed in the upper end of said container, said member having an exposed upper surface and having an opening in the bottom which flares outwardly and extends downwardly through said member into said chamber;

a vertical prong shaped plastic element which extends upwardly from said member and has a vertical bore extending upwardly from the lower end of said element to a point intermediate the ends of said element, the lower end of said element being secured to the upper surface of said member in the region of said opening to seal off said opening in a leak proof manner, said element, when manually pivoted about said opening, breaking away from said container and at the same time breaking the seal to expose said opening whereby said element can be removed from said container;

vertical bristles secured in said bore and extending out of the lower end of said element through said opening and into said container whereby when said element is broken away from said container, said element with said bristles can be removed from said container and said element can be used as a handle to repeatedly dip said bristles in the fluid to charge said bristles with fluid for repeated application as desired by a user; and a horizontal annular lip secured to the inner periphery of said member adjacent the upper end of said container for enabling excess fluid on the bristles to be wiped off when the bristles are moved over the lip.

2. The container and applicator of claim 1 further including fluid in said chamber, said container being chemically inert with respect to said fluid.

3. The container and applicator of claim 2 wherein the lower end of said container is open and is closed by a flat plastic disc sealed thereto, said container other than said disc and said element being a single integral unit.

4. The container and applicator of claim 3 wherein said container, element and disc are all formed from like plastic.

* * * * *